US008122724B2

(12) United States Patent
Slovisky et al.

(10) Patent No.: US 8,122,724 B2
(45) Date of Patent: Feb. 28, 2012

(54) COMPRESSOR INCLUDING AN AERODYNAMICALLY VARIABLE DIFFUSER

(75) Inventors: John A. Slovisky, Chandler, AZ (US); Michael T. Barton, Scottsdale, AZ (US); John A. Gunaraj, Chandler, AZ (US); Mahmoud L. Mansour, Phoenix, AZ (US); Donald L. Palmer, Cave Creek, AZ (US); Charles J. Paine, Tempe, AZ (US); George L. Perrone, Phoenix, AZ (US); Nick A. Nolcheff, Chandler, AZ (US)

(73) Assignee: Honeywell International, Inc., Morristown, NJ (US)

( * ) Notice: Subject to any disclaimer, the term of this patent is extended or adjusted under 35 U.S.C. 154(b) by 2576 days.

(21) Appl. No.: 10/931,502

(22) Filed: Aug. 31, 2004

(65) Prior Publication Data

US 2006/0045772 A1 Mar. 2, 2006

(51) Int. Cl.
*F02C 1/00* (2006.01)

(52) U.S. Cl. ..... 60/772; 60/240

(58) Field of Classification Search ..... 60/772, 60/240; 415/1

See application file for complete search history.

(56) References Cited

U.S. PATENT DOCUMENTS

| | | | | |
|---|---|---|---|---|
| 3,362,629 | A | 1/1968 | Papapanu | |
| 3,462,071 | A * | 8/1969 | Garve | 415/116 |
| 3,856,430 | A | 12/1974 | Langham | |
| 3,901,620 | A | 8/1975 | Boyce | |
| 3,972,642 | A | 8/1976 | Fricke et al. | |
| 4,131,389 | A | 12/1978 | Perrone et al. | |
| 4,371,310 | A | 2/1983 | Henry, IV et al. | |
| 4,459,802 | A | 7/1984 | Mowill | |
| 4,492,516 | A | 1/1985 | McCoy, Jr. | |
| 4,504,188 | A | 3/1985 | Traver et al. | |
| 4,722,181 | A * | 2/1988 | Yu | 60/776 |
| 5,351,473 | A * | 10/1994 | Shuba | 60/782 |
| 5,603,605 | A | 2/1997 | Fonda-Bonardi | |
| 7,185,495 | B2 * | 3/2007 | Leachman et al. | 60/772 |
| 2007/0224032 | A1 * | 9/2007 | Gu et al. | 415/58.4 |

FOREIGN PATENT DOCUMENTS

JP 58-9696 8/1982

OTHER PUBLICATIONS

Gary J. Skoch "Experimental Investigation of Centrifugal Compressor Stabilization Techniques", Turbo Expo 2003 cosponsored by the American Society of Mechanical Engineers and the International Gas Turbine Institute, Atlanta, Georgia, Jun. 16-19, 2003, U.S. Army Research Laboratory, Glenn Research Center, Cleveland, Ohio.

* cited by examiner

*Primary Examiner* — Ehud Gartenberg
*Assistant Examiner* — Andrew Nguyen
(74) *Attorney, Agent, or Firm* — Ingrassia Fisher & Lorenz, P.C.

(57) ABSTRACT

A compressor includes a diffuser, a recirculation duct, and a flow control valve. The recirculation duct has an inlet in fluid communication with the air outlet of the diffuser, and an outlet in fluid communication with the air inlet of the diffuser. The flow control valve is selectively moveable between open and closed positions, to thereby fluidly couple and isolate, respectively, the recirculation duct inlet and outlets. During operation of the compressor, the flow control valve may be opened, which circulates a portion of the compressed air discharged from the diffuser air outlet back to the diffuser air inlet. The air that is circulated back to the diffuser air inlet reduces the effective area of the diffuser air inlet, thereby increasing the surge margin of the compressor.

2 Claims, 5 Drawing Sheets

COMPRESSOR INCLUDING AN AERODYNAMICALLY VARIABLE DIFFUSER

STATEMENT REGARDING FEDERALLY SPONSORED RESEARCH OR DEVELOPMENTROSS-REFERENCES TO RELATED APPLICATIONS

This invention was made with Government support under Contract Number DAA-H10-02-0003 awarded by the U.S. Army. The Government has certain rights in this invention.

TECHNICAL FIELD

The present invention relates to compressors and, more particularly, to a compressor that includes an aerodynamically variable diffuser.

BACKGROUND

Aircraft main engines not only provide propulsion for the aircraft, but in many instances may also be used to drive various other rotating components such as, for example, generators, compressors, and pumps, to thereby supply electrical, pneumatic, and/or hydraulic power. However, when an aircraft is on the ground, its main engines may not be operating. Moreover, in some instances the main engines may not be capable of supplying power. Thus, many aircraft include one or more auxiliary power units (APUs) to supplement the main propulsion engines in providing electrical and/or pneumatic power. An APU may additionally be used to start the main propulsion engines.

An APU is, in most instances, a gas turbine engine that includes a combustor, a power turbine, and a compressor. During operation of the APU, compressor draws in ambient air, compresses it, and supplies compressed air to the combustor. The combustor receives fuel from a fuel source and the compressed air from the compressor, and supplies high energy compressed air to the power turbine, causing it to rotate. The power turbine includes a shaft that may be used to drive the compressor. In some instances, an APU may additionally include a starter-generator, which may either drive the turbine or be driven by the turbine, via the turbine output shaft. Some APUs additionally include a bleed air port between the compressor section and the turbine section. The bleed air port allows some of the compressed air from the compressor section to be diverted away from the turbine section, and used for other functions such as, for example, main engine starting air, environmental control, and/or cabin pressure control.

Although most APUs, such as the one generally described above, are robust, safe, and generally reliable, some APUs do suffer certain drawbacks. For example, when some APUs are operated at part power, the surge margin of the APU compressor, or at least one or more stages of the compressor, can be reduced. Thus, in many instances APU compressors include a diffuser that is not optimally designed for operations over the entire operational envelope of the APU, which can result in reduced operational efficiency (e.g., increased specific fuel consumption (SFC)) of the APU. Alternatively, some APUs include a surge valve, or mechanically variable diffuser vanes, which allow the geometry of the vanes within the diffuser to be varied. However, these systems and methods can be inefficient, complex, and costly.

Hence, there is a need for a system and method of controlling the surge margin, and thus improving the overall operational efficiency, of a compressor, that is more efficient, less complex, and less costly than existing systems and methods. The present invention addresses one or more of these needs.

BRIEF SUMMARY

The present invention provides a system and method of controlling the surge margin, and thus improving the overall operational efficiency, of a compressor.

In one embodiment, and by way of example only, a compressor includes a housing, an impeller, a diffuser, a recirculation duct, and a valve. The impeller is rotationally mounted within the housing and has a leading edge and a trailing edge. The impeller is operable, upon rotation thereof, to discharge a flow of relatively low pressure, high velocity air from the trailing edge. The diffuser has at least an air inlet and an air outlet. The diffuser air inlet is in fluid communication with the impeller trailing edge to thereby receive the flow of air supplied therefrom. The diffuser is configured to reduce the velocity magnitude of the air, increase the pressure magnitude of the air, and discharge the air at the increased pressure magnitude from the diffuser air outlet. The recirculation duct has an air inlet and an air outlet. The recirculation duct air inlet is in fluid communication with the diffuser air outlet, and the recirculation duct air outlet is in fluid communication with the diffuser air inlet. The valve is disposed at least partially within the recirculation duct and is moveable between at least a closed position, in which the recirculation duct air inlet is fluidly isolated from the recirculation duct air outlet, and an open position, in which the recirculation duct air inlet is in fluid communication with the recirculation duct air outlet, to thereby inject at least a portion of the relatively high pressure air discharged from the diffuser air outlet into the diffuser air inlet.

In another exemplary embodiment, a gas turbine engine includes a housing, a compressor, a combustor, a turbine, a recirculation duct, and a valve. The compressor, combustor, and turbine are all mounted in flow series within the housing, and the compressor includes at least an impeller and a diffuser. The impeller has a leading edge and a trailing edge, and is configured to rotate and is operable, upon rotation, to supply a flow of air having a velocity magnitude and a pressure magnitude. The diffuser has at least an air inlet and an air outlet. The diffuser air inlet is in fluid communication with the impeller trailing edge to thereby receive the flow of air supplied therefrom. The diffuser is configured to reduce the velocity magnitude of the air, increase the pressure magnitude of the air, and discharge the air at the increased pressure magnitude from the diffuser air outlet. The recirculation duct has an air inlet and an air outlet. The recirculation duct air inlet is in fluid communication with the diffuser air outlet, and the recirculation duct air outlet is in fluid communication with the diffuser air inlet. The valve is disposed at least partially within the recirculation duct and is moveable between at least a closed position, in which the recirculation duct air inlet is fluidly isolated from the recirculation duct air outlet, and an open position, in which the recirculation duct air inlet is in fluid communication with the recirculation duct air outlet, to thereby inject at least a portion of the air discharged from the diffuser air outlet into the diffuser air inlet.

In still another exemplary embodiment, a turbocharger includes a housing, a turbine, and a compressor, a recirculation duct, and a valve. The turbine is rotationally mounted within the housing, is configured to receive a flow of gas, and is operable, upon receipt of the gas flow, to supply a drive force. The compressor is mounted in within the housing and is coupled to receive the drive force from the turbine, and includes at least an impeller and a diffuser. The impeller has a leading edge and a trailing edge, and is configured to rotate and is operable, upon rotation, to supply a flow of air having a velocity magnitude and a pressure magnitude. The diffuser has at least an air inlet and an air outlet. The diffuser air inlet is in fluid communication with the impeller trailing edge to thereby receive the flow of air supplied therefrom. The diffuser is configured to reduce the velocity magnitude of the air, increase the pressure magnitude of the air, and discharge the air at the increased pressure magnitude from the diffuser air outlet. The recirculation duct has an air inlet and an air outlet. The recirculation duct air inlet is in fluid communication with the diffuser air outlet, and the recirculation duct air outlet is in fluid communication with the diffuser air inlet. The valve is disposed at least partially within the recirculation duct and is moveable between at least a closed position, in which the recirculation duct air inlet is fluidly isolated from the recirculation duct air outlet, and an open position, in which the recirculation duct air inlet is in fluid communication with the recirculation duct air outlet, to thereby inject at least a portion of the air discharged from the diffuser air outlet into the diffuser air inlet.

In yet a further exemplary embodiment, in a gas turbine engine including at least compressor that has an impeller, and a diffuser disposed downstream of the impeller, and in which the diffuser includes at least an air inlet and an air outlet, a method of varying the surge margin of the compressor includes determining an operational state of the engine, and selectively supplying air discharged from the diffuser air outlet to the diffuser air inlet based at least in part on the determined operational state.

Other independent features and advantages of the preferred gas turbine engine and compressor systems and methods will become apparent from the following detailed description, taken in conjunction with the accompanying drawings which illustrate, by way of example, the principles of the invention.

DETAILED DESCRIPTION OF A PREFERRED EMBODIMENT

Before proceeding with a detailed description, it is to be appreciated that the described embodiment is not limited to use in conjunction with a particular type of turbine engine or particular type of compressor. Thus, although the present embodiment is, for convenience of explanation, depicted and described as being implemented in a single-stage centrifugal compressor, and in an auxiliary power unit, it will be appreciated that it can be implemented as various other types of compressors, engines, turbochargers, and various other fluid devices, and in various other systems and environments.

Figure 1:
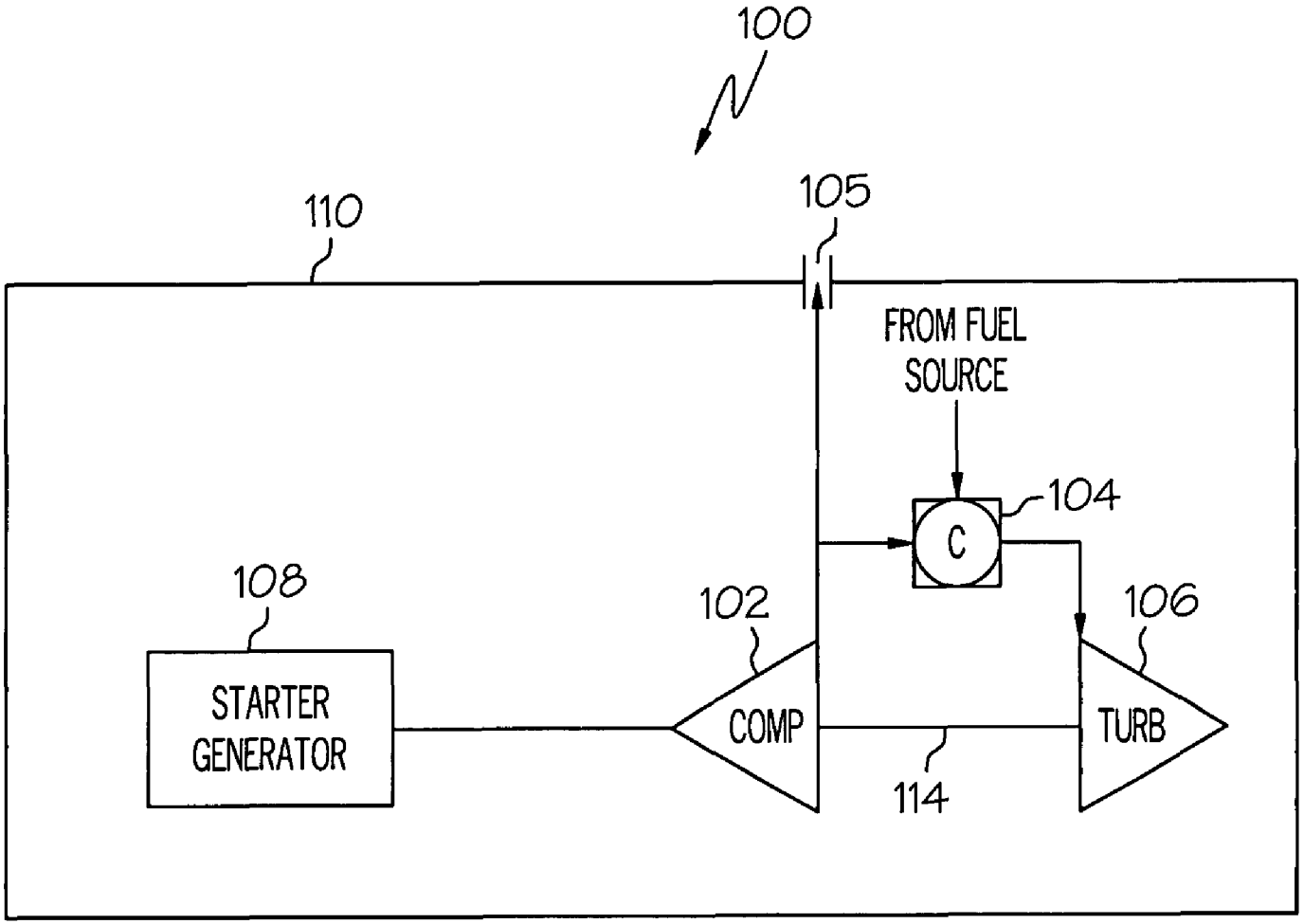
FIG. 1 is a schematic representation of an auxiliary power unit (APU) according to an exemplary embodiment of the present invention.

Turning now to the description, and with reference first to FIG. 1, an embodiment of an exemplary auxiliary power unit (APU) 100 is shown in simplified schematic form. The APU 100 includes a compressor 102, a combustor 104, a turbine 106, and a starter-generator unit 108, all preferably housed within a single containment housing 110. During operation of the APU 100, the compressor 102 draws ambient air into the containment housing 110. The compressor 102 compresses the ambient air, and supplies a portion of the compressed air to the combustor 104, and may also supply compressed air to a bleed air port 105. The bleed air port 105, if included, is used to supply compressed air to a non-illustrated environmental control system. It will be appreciated that the compressor 102 may be any one of numerous types of compressors now known or developed in the future. In a particular preferred embodiment, however, the compressor is a two-stage centrifugal compressor, an embodiment of which is described in more detail further below.

The combustor 104 receives the compressed air from the compressor 102, and also receives a flow of fuel from a non-illustrated fuel source. The fuel and compressed air are mixed within the combustor 104, and are ignited to produce relatively high-energy combustion gas. The combustor 104 may be implemented as any one of numerous types of combustors now known or developed in the future. Non-limiting examples of presently known combustors include various can-type combustors, various reverse-flow combustors, various through-flow combustors, and various slinger combustors.

No matter the particular combustor configuration 104 used, the relatively high-energy combustion gas that is generated in the combustor 104 is supplied to the turbine 106. As the high-energy combustion gas expands through the turbine 106, it impinges on the turbine blades (not shown in FIG. 1), which causes the turbine 106 to rotate. It will be appreciated that the turbine 106 may be implemented using any one of numerous types of turbines now known or developed in the future including, for example, a vaned radial turbine, a vaneless radial turbine, and a vaned axial turbine. In a particular preferred configuration, several embodiments of which are described further below, the turbine 106 is implemented as a vaneless radial turbine. No matter the particular type of turbine that is used, the turbine 106 includes an output shaft 114 that drives the compressor 102. Moreover, depending on the mode in which the APU 100 is operating, the turbine 106, via the output shaft 114, may also drive the starter-generator unit 108, or alternatively the turbine 106 may be driven by the starter-generator unit 108.

Figure 2A:
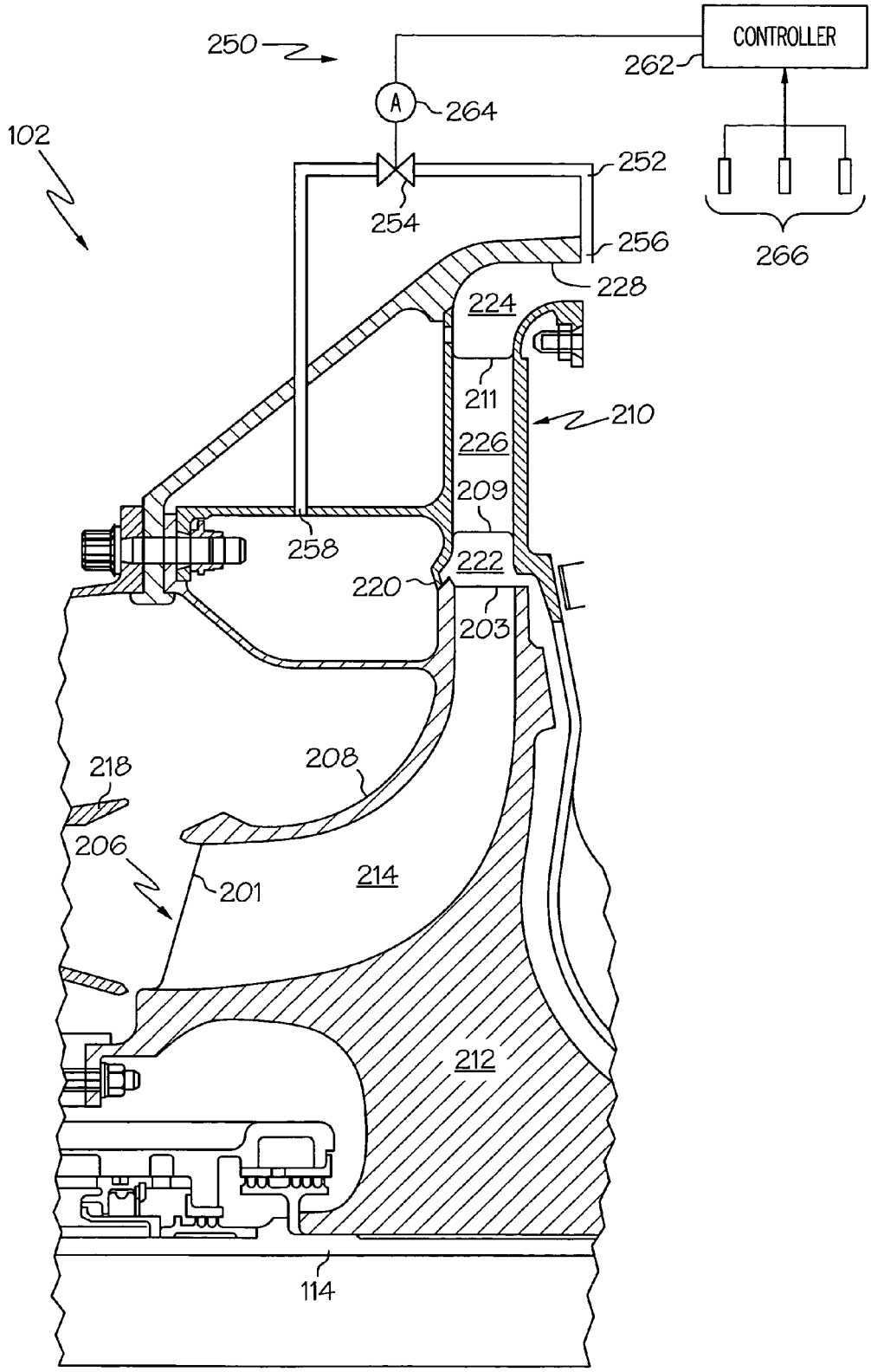
FIGS. 2A and 2B are cross section view of an exemplary and alternative compressor, respectively, that may be used in the APU of FIG. 1.

Turning now to FIG. 2A, a more detailed description of the compressor 102 will be provided. In the depicted embodiment, the compressor 102 is a single-stage centrifugal compressor and includes an impeller, 206, a shroud 208, and a diffuser 210. The impeller 206 is mounted on the output shaft 114, via a hub 212, and is thus rotationally driven by either the turbine 106 or the starter-generator 108, as described above. A plurality of spaced-apart blades 214 extend generally radially from the hub 212 and together therewith define a leading edge 201 and a trailing edge 203. As is generally known, when the impeller 206 is rotated, the blades 214 draw air into the impeller 206, via the leading edge 201, and increase the velocity of the air to a relatively high velocity. The relatively high velocity air is then discharged from the impeller 206, via the trailing edge 203.

The shroud 208 is disposed adjacent to, and partially surrounds, the impeller blades 214. The shroud 208, among other things, cooperates with an annular inlet duct 218 to direct the air drawn into the APU 100 by the compressor 102 into the impeller 206. As will be described in more detail further below, the shroud 208, at least in the depicted embodiment, additionally includes a plurality of injection passages 220

(only one shown in FIG. 2), which are used to inject air from downstream of the diffuser 210 back into the region upstream of the diffuser 210.

The diffuser 210 is disposed adjacent to, and surrounds a portion of, the impeller 206, and includes an air inlet 222 and an air outlet 224. In the depicted embodiment, the diffuser 210 is a radial vaned diffuser and, thus, further includes a plurality of diffuser vanes 226. However, it will be appreciated that the diffuser 210 could be implemented as any one of numerous other diffusers, including a vaneless radial diffuser. The diffuser vanes 226 are arranged substantially tangential to the impeller trailing edge 203 and, similar to the impeller blades 214, define a leading edge 209 and a trailing edge 211. As shown in FIG. 2A, the diffuser air inlet 222 is in fluid communication with the impeller trailing edge 203. Thus, the relatively high velocity air discharged from the impeller 206 flows into and through the diffuser air inlet 222. As the air flows through the diffuser 210, the diffuser 210 reduces the velocity of the air and increases the pressure of the air to a higher magnitude.

During some operating conditions, such as during part speed operations, the inlet flow of the compressor 102 can be reduced and, in some instances, can result in a surge condition. To increase the surge margin of the compressor 102 for a given airflow into the compressor 102, the compressor 102 further includes a recirculation system 250. The recirculation system 250 includes a recirculation duct 252 and one or more flow control valves 254. In the depicted embodiment, the recirculation duct 252 is coupled between a discharge duct 228 downstream of the diffuser outlet 224 and the shroud 208, and includes an air inlet 256 and an air outlet 258. Thus, the recirculation duct air inlet 256 is in fluid communication with the diffuser air outlet 224, via the flow duct 228, and the recirculation duct air outlet 258 is in fluid communication with the diffuser air inlet 222, via the shroud 208.

In the depicted embodiment, the flow control valve 254 is mounted on, and extends into, the recirculation duct 252. The flow control valve 254, which may be any one of numerous types of valves, is moveable between a closed position and an open position. In the closed position, the recirculation duct air inlet 256 is fluidly isolated from the recirculation duct air outlet 258, and air flow through the recirculation duct 252 is prevented. Conversely, when the flow control valve 254 is in the open position, which may be the full-open position or any one of numerous throttled positions, the recirculation duct air inlet 256 is in fluid communication with the recirculation duct air outlet 258, and a portion of the air discharged from the diffuser air outlet 224 flows through the recirculation duct 252 and is injected into the diffuser air inlet 222. It will be appreciated that although a single flow control valve 254 is shown, a plurality of flow control valves 254 could be used, and the positions of each scheduled to provide a desired flow through the recirculation duct 252.

Figure 2B:
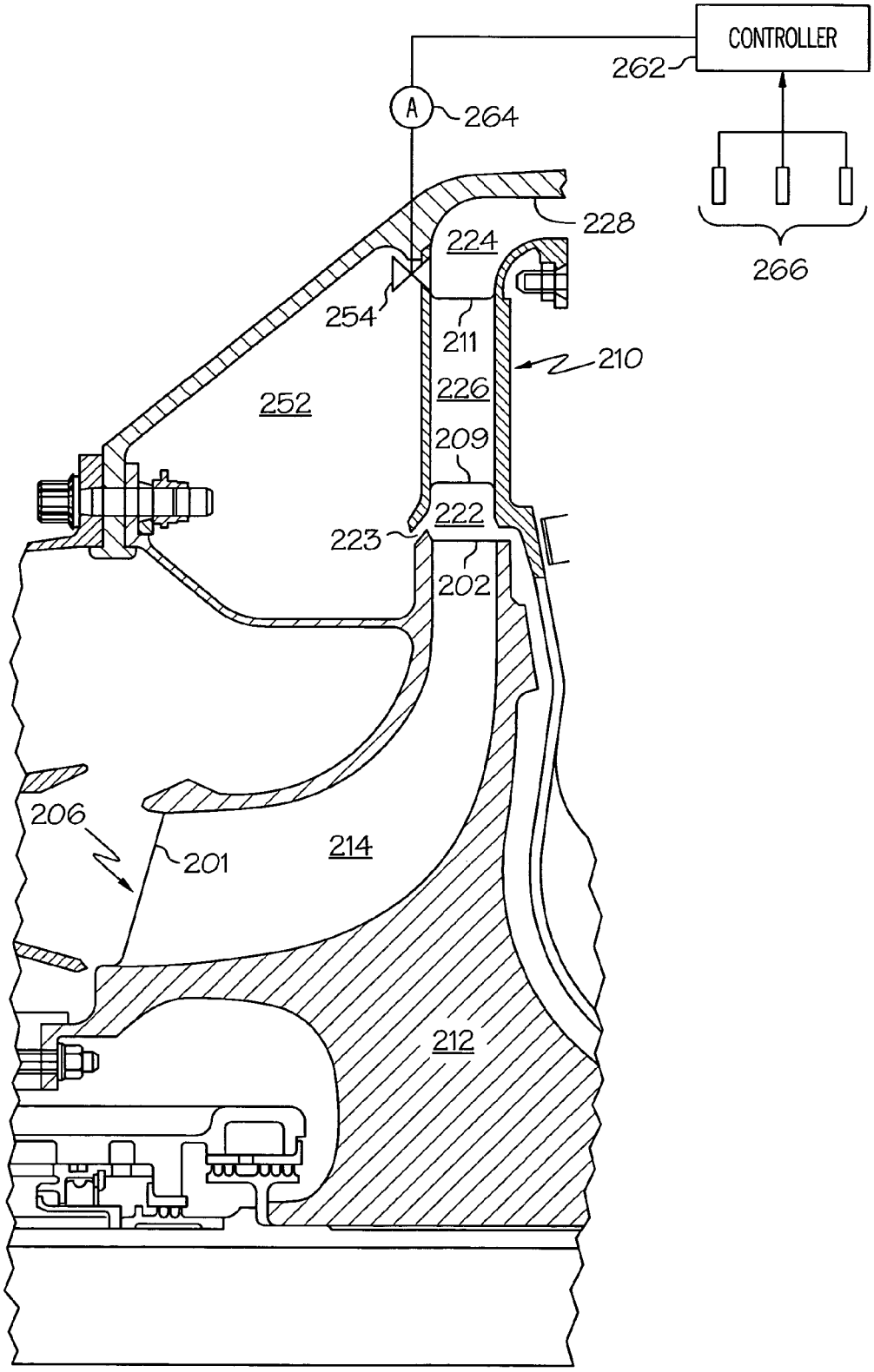

Before proceeding further, it should be appreciated that although the recirculation duct 252 is depicted as being implemented as a separate duct or conduit, this is merely exemplary of any one of numerous implementations. For example, as shown in FIG. 2B, an open space or cavity within the containment housing 110 could be used to define the recirculation duct 252. Moreover, although the recirculation duct air inlet 256 is shown coupled immediately downstream of the diffuser air outlet 225, it will be appreciated that it could be coupled at any one of numerous locations downstream of the diffuser air outlet 224. It will additionally be appreciated that mounting the flow control valve 254 on the recirculation duct 252 is merely exemplary, and that it could be mounted elsewhere. For example, the flow control valve 254 could be mounted on the compressor discharge duct 228, as is shown in FIG. 2B, or on the shroud 208.

Returning once again to the description, the position of the flow control valve 254 is preferably controlled via valve position commands supplied by a controller 262. As such, the flow control valve 254 includes a valve actuator 264 that is configured to receive the valve position commands and, in response to the commands, move the flow control valve 254 to the commanded position. It will be appreciated that the valve actuator 264 may be any one, or combination, or numerous types of actuators including, for example, pnuematic, hydraulic, or electric. It will additionally be appreciated that the controller 262 may be a dedicated valve controller, or may be implemented as part of another system controller. For example, the controller 262 may be an engine controller, such as a FADEC, that includes the additional functionality of positioning the flow control valve 254. No matter the specific manner in which the controller 262 is implemented, the controller 262 preferably receives one or more sensor signals from one or more sensors 266. These sensor signals are one or more signals representative of engine operating conditions such as, for example, impeller rotational speed, shaft speed, and bleed air flow just to name a few. In response to the sensor signals, the controller 262 determines whether the flow control valve 254 should be commanded to the open or closed position.

As was noted above, when the flow control valve 254 is in the open position, a portion of the air discharged from the diffuser air outlet 224 flows through the recirculation duct 252 and is injected into the diffuser air inlet 222. Preferably, when the air from the diffuser air outlet 224 is injected into the diffuser air inlet 222, the flow is injected such that the effect on diffuser performance is minimal. To implement this desired functionality, the air in the recirculation duct 252 is injected into the diffuser air inlet 222 via a plurality of injection passages 220. As was previously noted, these injection passages 220 are preferably formed through the shroud 208. In the embodiment depicted in FIG. 2A, the injection passages 220 are implemented as a plurality of flow passages. However, as depicted in the alternative embodiment depicted in FIG. 2B, instead of a plurality of injection passages 220, one (or more) injection passage 220, implemented as an annular slot 223, could be used. It will additionally be appreciated that in other alternative embodiments the injection passage(s) 220 could be formed as part of the recirculation duct air outlet 258, the diffuser 210, or various other portions of the compressor 102, and not just as part of the shroud 208.

Figure 3:
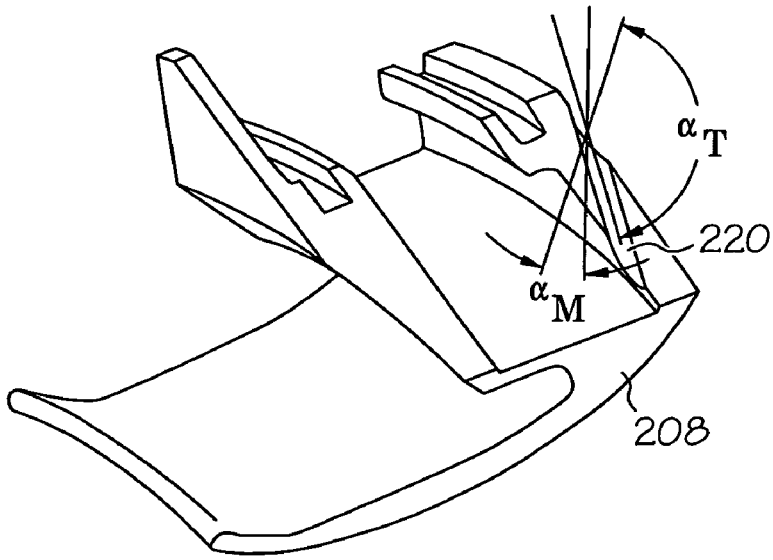
FIGS. 3 and 4 are three dimensional partial cross section views of an exemplary shroud that may be used in the compressor of FIG. 2A or 2B.
Figure 4:
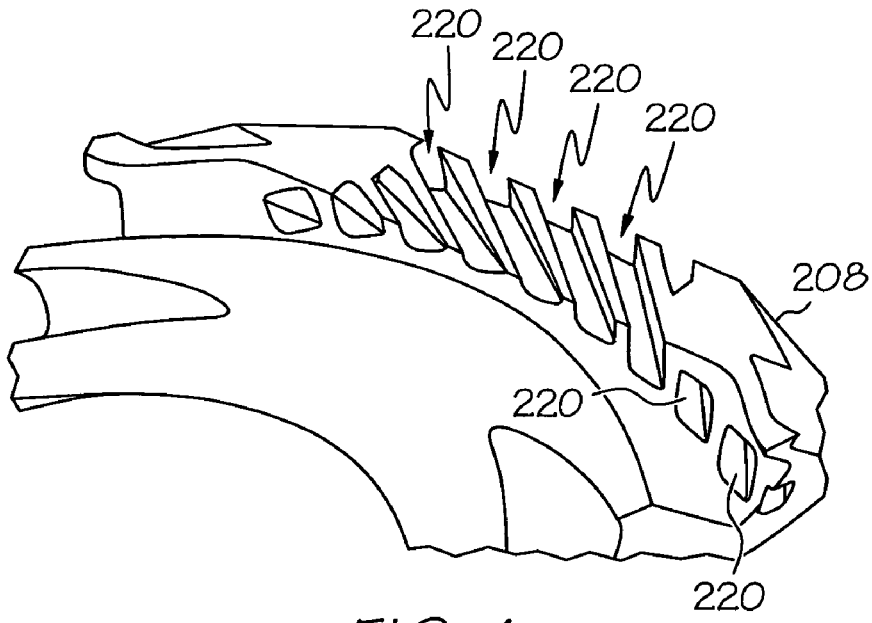

Turning now to FIGS. 3 and 4, an exemplary physical implementation of a portion of the shroud 208 is shown, and depicts a particular preferred configuration of the injection passages. As was just noted, the injection passages 220 are preferably configured such that when air from the recirculation duct 252 is injected into the diffuser inlet 222, its effect on performance is minimal. Thus, in a particular preferred embodiment, the injection passages 220 are configured to inject a predetermined amount of flow into the diffuser air inlet 222. In addition, as shown most clearly in FIG. 3, the injection passages 220 are preferably configured to inject the flow at a predetermined side (or meridional) injection angle ($\alpha_M$), and at predetermined swirl (or tangential) injection angle ($\alpha_T$) that yield the minimal impact on diffuser 210 performance. The amount of flow that is injected is based, at least in part, on the increase in surge margin desired. The injection passages 220 are preferably configured to control the amount of flow, and to provide enough guidance to direct the flow at the appropriate meridional angle ($\alpha_M$) and tangential angle ($\alpha_T$).

It will be appreciated that each of the above-described parameters may vary from application to application. However, in a particular preferred exemplary implementation, the meridional angle ($\alpha_M$) is preferably less than or equal to about 20-degrees, and the tangential angle ($\alpha_T$) is preferably less than or equal to about 65-degrees and most preferably close to the diffuser leading edge angle. Moreover, the injection passages 220 are preferably configured to inject 10% flow into the diffuser air inlet 222. In one particular physical implementation, it has been found that including 67 injection passages 220 in the shroud 208 that are formed at the predetermined meridional angle ($\alpha_M$) and tangential angle ($\alpha_T$), and having an effective length-to-diameter ratio of about 4, provide the desired characteristics.

Having described the configurations of the engine 100, the compressor 102, and the recirculation system 250, and the general functionality of each, a more detailed description of the overall operation and interaction of the engine 100 and recirculation system 150 will now be provided. As noted above, the engine 100 includes various sensors 266 that sense one or more engine operating conditions, and supply sensor signals representative of the sensed parameters to the controller 262. The controller 262, based at least in part on the sensor signals, determines the operational state of the engine 100 and supplies, among other things, appropriate command signals to the valve actuator 264, to thereby move the valve 254 to the appropriate position.

For example, if the controller 262 determines that the operating conditions of engine 100 are such that a surge condition is not likely, such as at full power on a turbine engine or bleed mode in an APU, the controller 262 will issue appropriate command signals that ensure the flow control valve 254 is in, or is moved to, the closed position. As a result, no air discharged from the compressor 202 is circulated back to the diffuser air inlet 222. Conversely, if the controller 262 determines that the operating conditions of the engine 100 are such that the surge margin is sufficiently reduced, or a surge condition is potentially likely, such as operation at part speed on a turbine engine or shaft output only on an APU, the controller 262 will issue appropriate valve position command signals to cause the flow control valve 154 to move to the open position. As a result, a portion of the air discharged from the compressor 202 will be bled away from the compressor second stage 204, and into the recirculation duct 252. The air in the recirculation duct is then directed into the diffuser air inlet 222.

Figure 5:
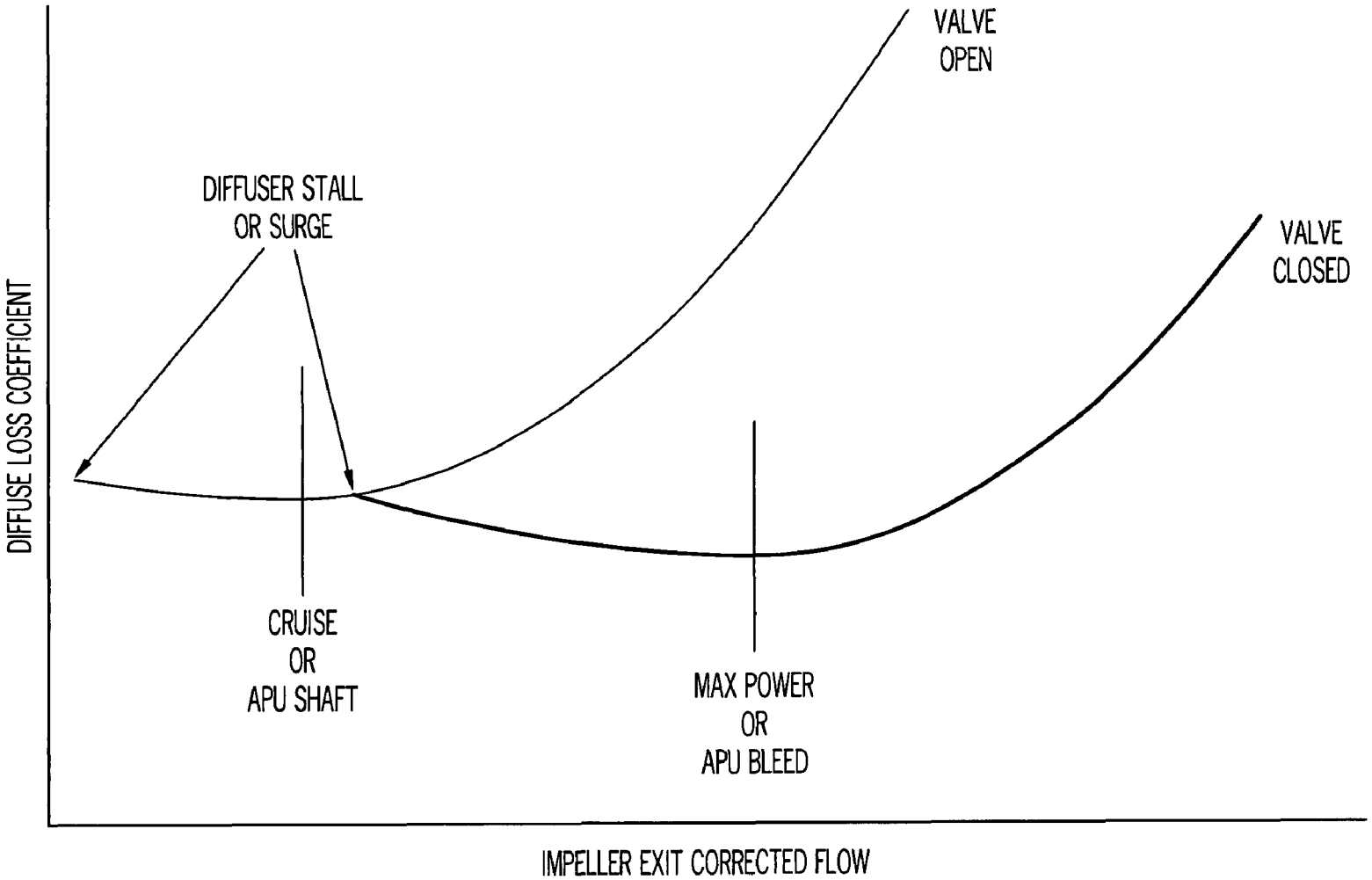
FIG. 5 is a graph depicting the operational characteristics of an exemplary diffuser in accordance with an embodiment of the present invention.

The system and method described herein aerodynamically varies the effective area at the diffuser leading edge 209. Specifically, when air discharged from the compressor 202 is circulated back, and injected into, the diffuser air inlet 222, the injected flow reduces the effective flow area at the diffuser air inlet 222. As shown in FIG. 5, this reduced effective flow area shifts the diffuser loss bucket, thereby providing a more optimal impeller/diffuser match at lower power or non-bleed-air conditions and moves the diffuser away from surge.

Although the compressor 102 was depicted and described herein as being implemented as a single-stage centrifugal compressor, and in an auxiliary power unit, it will be appreciated that it can also be implemented as various other types of compressors, and in various types of engines, turbochargers, and various other fluid devices, and in various other systems and environments.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A compressor, comprising:

a housing;

an impeller rotationally mounted within the housing and having a leading edge and a trailing edge, the impeller operable, upon rotation thereof, to discharge a flow of air having a velocity magnitude and a pressure magnitude from the trailing edge;

a diffuser having at least an air inlet and an air outlet, the diffuser air inlet in fluid communication with the impeller trailing edge to thereby receive the flow of air discharged therefrom, the diffuser configured to reduce the velocity magnitude of the air, increase the pressure magnitude of the air, and discharge the air at the increased pressure magnitude from the diffuser air outlet;

a recirculation duct having an air inlet and an air outlet, the recirculation duct air inlet in fluid communication with the diffuser air outlet, the recirculation duct air outlet in fluid communication with the diffuser air inlet;

a shroud at least partially surrounding at least a portion of the impeller and including a plurality of injection passages extending therethrough, each injection passage extending through the shroud at a meridional angle of less than or equal to about 20 degrees and at a tangential angle of less than or equal to about 65 degrees, each injection angle further providing fluid communication between the recirculation duct and the diffuser air inlet;

a valve disposed at least partially within the recirculation duct and moveable between at least (i) a closed position, in which the recirculation duct air inlet is fluidly isolated from the recirculation duct air outlet, and (ii) an open position, in which the recirculation duct air inlet is in fluid communication with the recirculation duct air outlet, to thereby inject at least a portion of the air discharged from the diffuser air outlet into the diffuser air inlet; and wherein each injection passage has a predetermined effective length and a predetermined effective diameter; and a ratio of the injection passage predetermined effective length to predetermined effective diameter is about 4.

2. A gas turbine engine, comprising:

a housing;

a compressor, a combustor, and a turbine all mounted in flow series within the housing, the compressor including at least:

an impeller having a leading edge and a trailing edge, the impeller configured to rotate and operable, upon rotation, to discharge a flow of air having a velocity magnitude and a pressure magnitude from the trailing edge;

a diffuser having at least an air inlet and an air outlet, the diffuser air inlet in fluid communication with the impeller trailing edge to thereby receive the flow of air discharged therefrom, the diffuser configured to reduce the velocity magnitude of the air, increase the pressure magnitude of the air, and discharge the air at the increased pressure magnitude from the diffuser air outlet;

a recirculation duct having an air inlet and an air outlet, the recirculation duct air inlet in fluid communication with the diffuser air outlet, the recirculation duct air outlet in fluid communication with the diffuser air inlet;

a shroud at least partially surrounding at least a portion of the impeller and including a plurality of injection passages extending therethrough, each injection passage extending through the shroud at a meridional angle of less than or equal to about 20 degrees and at a tangential angle of less than or equal to about 65 degrees, each injection angle further providing fluid communication between the recirculation duct and the diffuser air inlet;

a valve disposed at least partially within the recirculation duct and moveable between at least (i) a closed position, in which the recirculation duct air inlet is fluidly isolated from the recirculation duct air outlet, and (ii) an open position, in which the recirculation duct air inlet is in fluid communication with the recirculation duct air outlet, to thereby inject at least a portion of the air discharged from the diffuser air outlet into the diffuser air inlet; and wherein each injection passage has a predetermined effective length and a predetermined effective diameter; and a ratio of the injection passage predetermined effective length to predetermined effective diameter is about 4.

* * * * *